United States Patent [19]

Easley

[11] Patent Number: 4,489,968

[45] Date of Patent: Dec. 25, 1984

[54] SELECTIVELY OPERABLE DOORSTOP FOR CONVERTING A DOUBLE-ACTING DOOR TO A SINGLE-ACTING DOOR

[76] Inventor: Thomas E. Easley, 1303 Fourth St., LaGrande, Oreg. 97850

[21] Appl. No.: 303,781

[22] Filed: Sep. 21, 1981

[51] Int. Cl.[3] ..... E05C 21/02

[52] U.S. Cl. ..... 292/340; 292/288; 16/86 A

[58] Field of Search ..... 292/1, 149, 340, 153, 292/288, 147; 49/141, 400; 16/86 A

[56] References Cited

U.S. PATENT DOCUMENTS

| | | | |
|---|---|---|---|
| 438,626 | 10/1890 | Kern | 292/288 X |
| 925,184 | 6/1909 | Hess | 292/74 X |
| 1,375,769 | 4/1921 | Bleackacek | 292/288 X |
| 2,264,962 | 12/1941 | Adams | 292/147 |
| 2,527,413 | 10/1950 | Grossman | 292/147 |
| 2,532,586 | 12/1950 | Wickwire | 292/288 |
| 3,130,455 | 4/1964 | Borlenghi | 49/504 |
| 4,021,880 | 5/1977 | Murphy | 292/340 X |
| 4,110,867 | 9/1978 | Gwozdz | 49/141 X |

*Primary Examiner*—Richard E. Moore

*Attorney, Agent, or Firm*—Chernoff, Vilhauer, McClung, Birdwell & Stenzel

[57] ABSTRACT

A selectively removable or retractable doorstop for converting double-acting, double or single doors to a single-acting, single door, for permitting control over traffic into and out of public premises at desired times. The doorstop includes an intercept portion which can be selectively removably or retractably inserted into the path of a double-acting door thereby restricting it to opening in one direction only. Different embodiments of the doorstop are provided respectively for temporary or permanent mounting on or in a doorjamb, or on or in the stile of a temporarily fixed-in-place door, thus giving a selection of options for any specific situation.

10 Claims, 10 Drawing Figures

FIG. 1
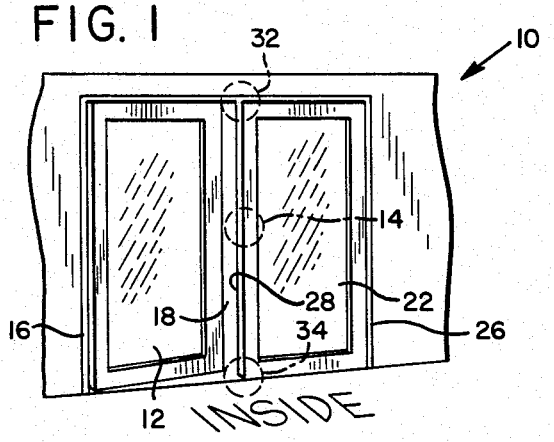
FIG. 2
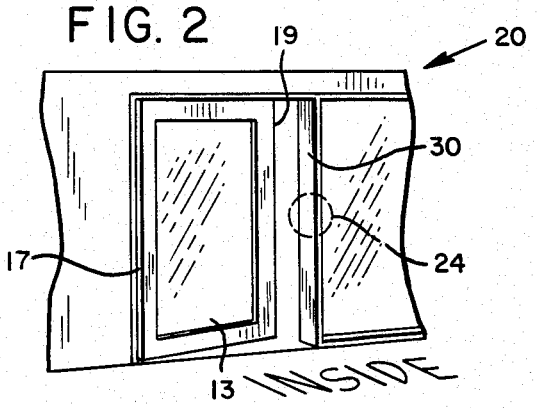
FIG. 3
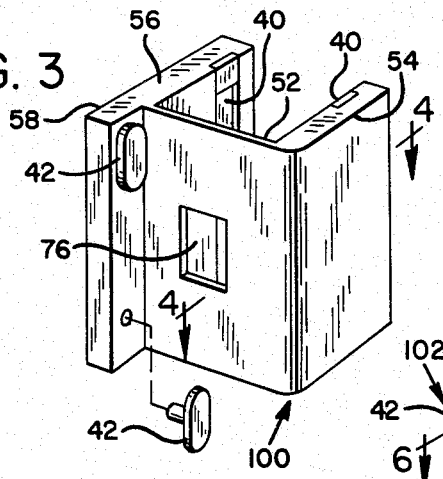
FIG. 4
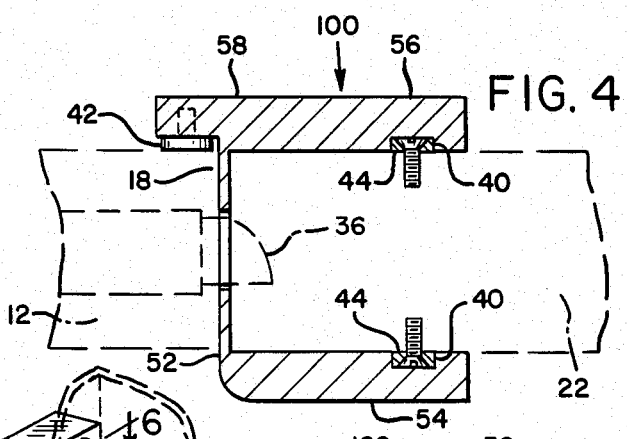
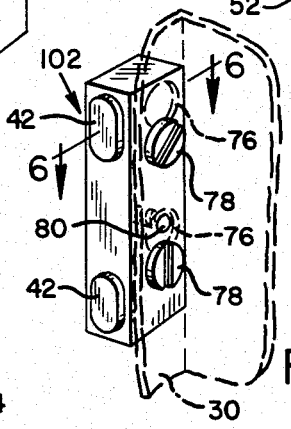
FIG. 5
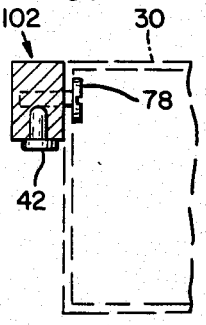
FIG. 6
FIG. 7
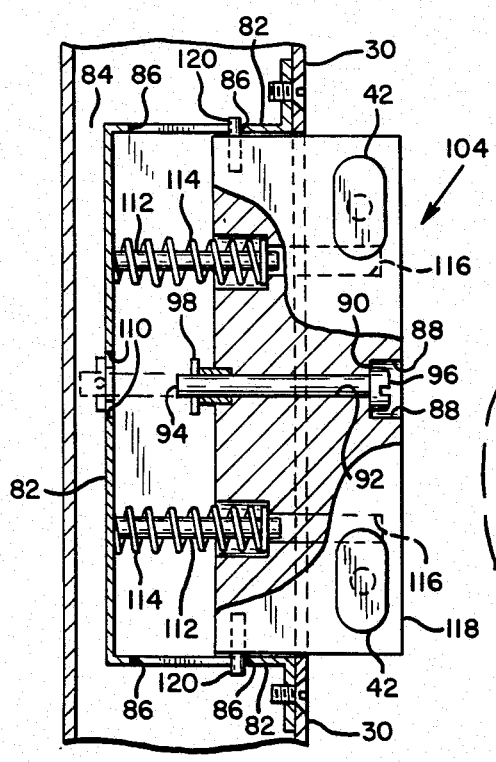
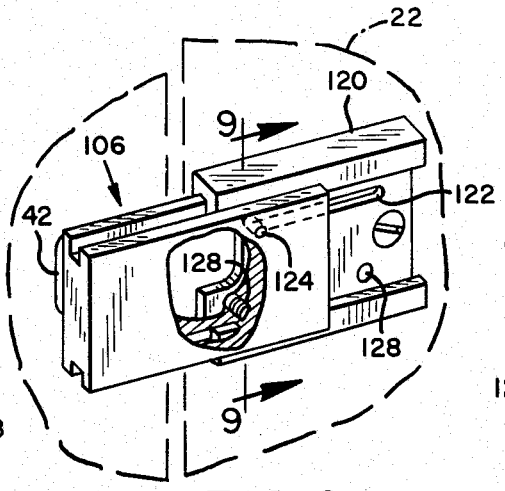
FIG. 8
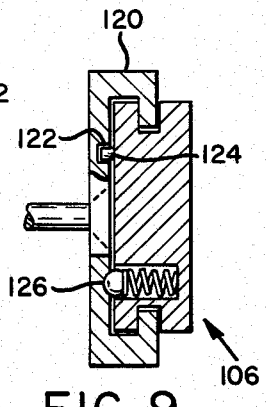
FIG. 9

SELECTIVELY OPERABLE DOORSTOP FOR CONVERTING A DOUBLE-ACTING DOOR TO A SINGLE-ACTING DOOR

BACKGROUND OF THE INVENTION

Doors of the type called "double acting", that is, that swing both to the inside and to the outside from their closed position, are widely used in business and public establishments because of the flexibility they afford visitors. Visitors have only to push to open the door, whether entering or leaving the establishment and, when such doors are combined into so-called "double doors", even more benefits are obtained.

Unfortunately, such doors do not provide as much traffic control, environmental control or security as might be desired at times. For example, often in the evening near closing time, a shopkeeper will prefer to lock one of the doors and have the other either locked or fixed so that it will open only toward the outside. This permits a degree of traffic control which is not obtainable even with a single, double-acting door. Also, double-acting doors have a tendency to stand partially open whenever there is enough wind pressure against them, thus wasting heat and creating an uncomfortable environmental situation inside.

Several efforts have been made to solve these problems. For example, the invention described in Kennon U.S. Pat. No. 4,155,576 is directed toward keeping double-acting doors closed against strong wind pressure, but offers no help with traffic control. Mongor U.S. Pat. No. 3,353,857 reveals an anti-swing door protector for flexible doors, such as are often used in hospitals, commercial kitchens and the like, which likewise provides protection against wind but offers no help with traffic control. Murphy U.S. Pat. No. 4,021,880 shows a device which is similar in some respects to one of the forms of the present invention but which is not selectively changeable between operable and inoperable modes, nor is it strong enough to withstand the rigors of use for which the present invention is intended. The astragal and flush bolt assembly of the DiFazio U.S. Pat. No. 4,058,322 comprises an extruded astragal that is designed to be mounted over the edge of an opposing door so as to convert one of a pair of double-acting doors to a single-acting door. This however is likewise not a selectively changeable device which can convert a double-acting door to a single-acting door in a few seconds, such as a shopkeeper would require in the often hectic moments before closing time.

In addition to the foregoing, applicant is aware of a type of doorstop for a double-acting door which comprises a vertically oriented pin releasably mounted in the header over the top of a door. Ordinarily the pin is supported inside the header, out of the way of the door. When it is needed, it is released by rotation which causes it to drop down under the force of gravity. Devices of this type have the serious drawback that, due to their location at one end of the door, sigificant twisting torque is applied to the door when it closes, creating stresses that eventually damage the door.

SUMMARY OF THE PRESENT INVENTION

The present invention solves the problem of the shopkeeper who desires to permit maximum free access to and from his premises during business hours and during good weather, but needs to convert his double-acting door or doors quickly and easily to a single-acting door near closing hours or during inclement weather.

The doorstop of this invention makes it possible to selectively convert a double-acting door to a single-acting door in a matter of seconds, and to eliminate such conversion with equal facility. If the door is one of a pair of such doors, the other door has only to be locked and the conversion to single-acting status can be accomplished quickly.

The doorstop comprises a door intercept device which is selectively insertable into the path of the door desired to be converted, so that it can no longer operate as a double-acting door but is restricted in its operation to single action, that is, opening in just one direction. The intercept device is adapted to be located approximately halfway between the top and bottom of the door to reduce twisting torque on the door and is selectively removably or retractably mounted on a mounting device which is in turn fixedly fastened to a fixed support. The fixed support can be a doorjamb or a stile of a fixed door. The intercept device can be any of several operable designs, of different complexities and costs, to suit any of several applications.

It is therefore a principal objective of the present invention to provide a new and improved doorstop device for selectively converting a double-acting door to a single-acting door.

It is a further objective to provide such a device which can be readily selectively removably or retractably placed in position.

It is yet a further objective to provide such a device that is located halfway between the top and bottom of the door to reduce twisting torque of the door.

The foregoing objectives and advantages, and other objectives, advantages and benefits of the invention will be more readily perceived and understood upon consideration of the following detailed description of the invention taken in conjuction with the accompanying drawings.

BRIEF DESCRIPTION OF THE DRAWINGS

FIG. 1 is an exemplary view of a double door, with opposed double-acting doors on each side, showing the general location of the selectively operable doorstop of the present invention.

FIG. 2 is an exemplary view of a single, double-acting door showing the general location of the selectively operable doorstop.

FIG. 3 is a perspective view of a first embodiment of the doorstop, adapted to be removably mounted on one of a typical pair of double doors.

FIG. 4 is a cross-sectional view taken along line 4—4 of FIG. 3.

FIG. 5 is a perspective view of a second embodiment of the doorstop adapted to be removably mounted on a fixed support which typically might be a jamb of a single, double-acting door.

FIG. 6 is a cross-sectional view taken along line 6—6 of FIG. 5.

FIG. 7 is a cross-sectional view of a third embodiment of the doorstop adapted for permanent, retractable mounting.

FIG. 8 is perspective view of a fourth embodiment of the doorstop, likewise adapted for permanent, retractable mounting.

FIG. 9 is a cross-sectional view taken along line 9—9 of FIG. 8.

DETAILED DESCRIPTION OF THE PRESENT INVENTION

Figure 10:
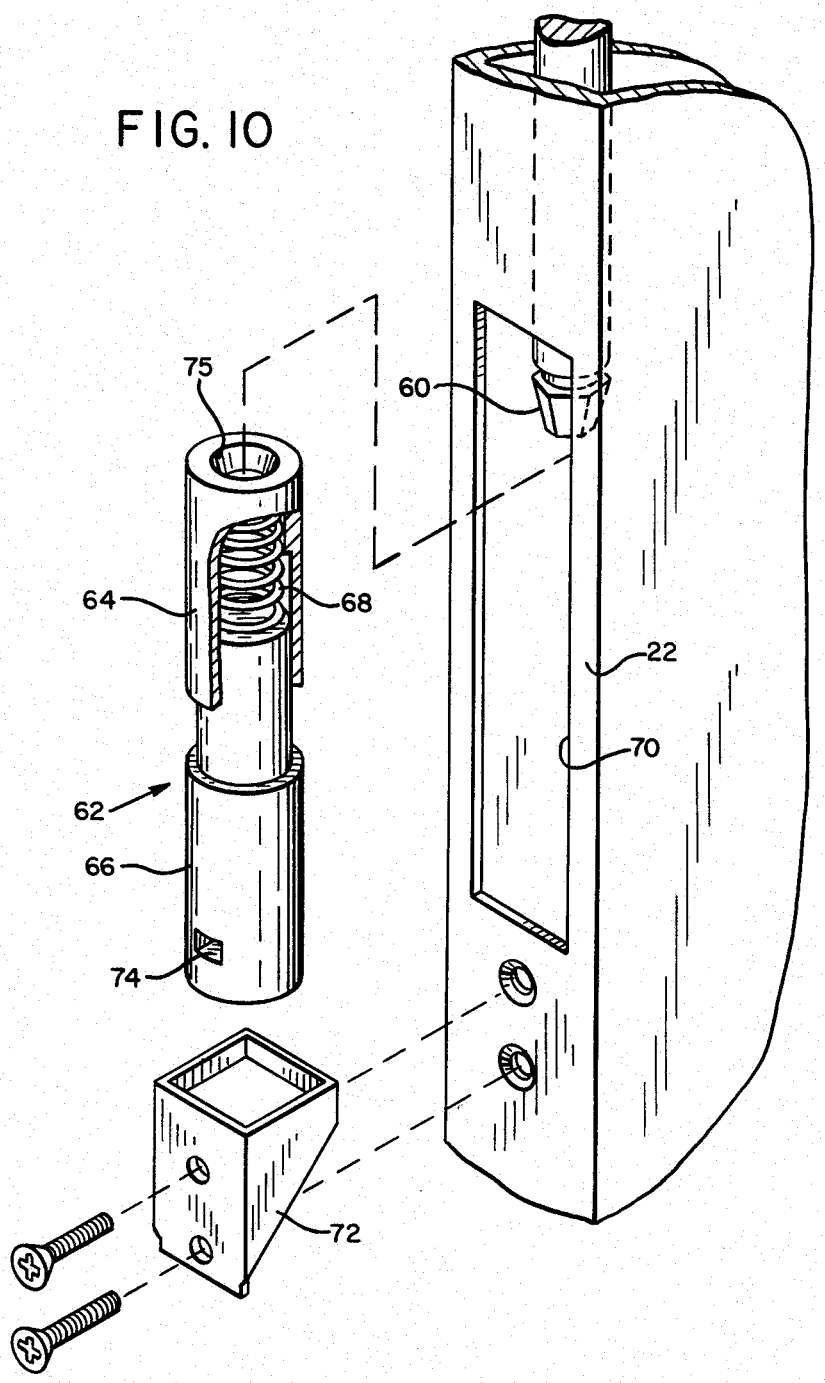
FIG. 10 is an exploded isometric view of a retainer assembly removably insertable into a typical strike cutout, for holding a header-bolt of one of a pair of double-acting doors in locked position.

FIG. 1 shows a general representation of a double doorway 10 with a pair of double-acting doors 12 and 22. The door 12 has a hinged edge 16 and a swinging edge 18, while the door 22 has a hinged edge 26 and a swinging edge 28. The door 12, as shown, is partially opened to the outside. The edge 28 of the door 22 is fixed in place by a locking mechanism located in one or both of the positions marked by the dotted circles 32 and 34 at the top and bottom corners respectively of the normally swinging edge 28, forming a fixed support for the purposes of the invention. The doorstop of the invention is mounted within the dotted circle 14 substantially in the vertical, longitudinal center of the fixed swinging edge 28 of the door 22. The function of the invention is to selectively convert the pair of double-acting doors 12 and 22 to a single door 12 opening only to one side of the doorway (the outside, for example).

FIG. 2 shows a general representation of a doorway 20 with a single, double-acting door 13 having a hinged edge 17 and swinging edge 19. The doorstop means of the invention is mounted within the dotted circle 24 which is located substantially in the vertical, longitudinal center of the fixed support which is the doorjamb 30. When the doorstop is operable, the door 12 will open only to one side of the doorway (the outside, for example.)

Specific embodiments of the invention enable it to be adapted to almost any of the physical configurations of doors and doorways that can be found. FIGS. 3 and 4, for example, show one embodiment of the doorstop for permitting the conversion of one pair of double-acting doors into a single-acting door with the other door fixed in place. Shown in FIG. 4 is a portion of the swinging edge 18 of the door 12, in the vicinity of the latch 36. The doorstop comprises an intercept device 100 mounted on a fixed support, which in this case is the stile of the door 22 which is immediately opposite and adjacent to the swinging edge 18 of the door 12 when it is in its closed position. The intercept device 100 is, preferably, fabricated of extruded aluminum in the modified U-shape shown, with the center portion 52 attached to the leg portions 54 and 56, and an extension 58 of the leg portion 56 extending in the opposite direction to intercept the swinging edge 18 of the door 12. The intercept device 100 preferably has mounted on its face cushions 42, to absorb the shock of the door 12 closing. Fabricated into the structure of the intercept device 100 are grooves 40 on the inside of each leg 54, 56, designed to matingly and slidably engage respective mounting blocks 44 fixedly fastened respectively to the inside and the outside of the stile of the temporarily fixed swinging edge of the inactive door 22. The tops of the grooves 40 are blocked so as to support the intercept device 100 vertically upon the blocks 44 when in operation. To render the intercept device 100 inoperable, it is simply lifted vertically off of the mounting blocks 44 and thereby removed.

The door 22 can be fixed in place by any of several well-known means. However, when a vertically movable header-bolt is provided, of the type designated as 60 in FIG. 10, the use of a novel removable retainer assembly indicated generally as 62 is preferred. This retainer assembly 62 is composed of two cylinders 64 and 66, one of which slides inside the other. When so assembled, the cavity in cylinder 64 defines a chamber to hold a spring 68, which tends to force them apart. When the retainer assembly 62 is inserted into the strike cutout 70 in the edge of the door 22, supported by an appropriate bracket or ledge such as 72, the spring pressure presses the header bolt 60 into the header strike, locking the door 22 in place so that it becomes a fixed support for the purposes of the invention. An aperture 74 is provided for the insertion of an appropriate tool for aiding in the installation and removal of the retainer assembly 62. The hollow cylinder 64 can have a cavity 75 in its top face for matingly engaging the bottom end of the header bolt 60.

The intercept device 100 can include an aperture 76 to receive the latch 36 of the door 12, or to receive a dead-bolt (not shown) for more secure locking of the door. In FIG. 4 it will be seen that the contact surfaces of the cushions 42 are co-planar with the inside surface of the temporarily fixed door 22, so that the doors will be aligned when they are closed.

FIGS. 5 and 6 show a selectively demountable doorstop of a different type than seen in FIGS. 3 and 4. The face of the fixed support, typically a doorjamb such as 30, contains slotted or key-shaped apertures 76 of any of several well-known designs. The intercept device 102 incorporates engagement lugs or screws 78, which matingly and slidably engage the slotted apertures 76 and hold the intercept device 102 removably fixedly in place. The intercept device 102 has a spring-loaded detent ball 80 which fits into one of the apertures 76 to keep it in place until it is desired to remove it. Cushions 42 of the type previously discussed are provided to absorb the shock of the closing door 13. The fixed support may alternatively constitute a temporarily fixed-in-place swinging edge of a double-acting door as in the previous embodiment.

FIG. 7 shows a permanently, rather than removably, mounted intercept device 104 which nevertheless is selectively operable. The doorjamb 30 is typical of the jambs used in doorways mounting a single, double-acting door such as is shown in FIG. 2. Toward the inner side of the doorjamb is mounted, inside the jamb 30, a rectangular box-like receptacle 82 which is fastened to the jamb by any of several familiar means. The receptacle 82 does not extend the full depth of the jamb 30 but has a space 84 behind it for purposes hereinafter described. The receptacle 82 also has elongate rectangular slots 86 in its top and bottom walls. The face of the receptacle 82 is open, as is the portion of the doorjamb 30 which receives it, creating a rectangularly shaped cavity in the face of the doorjamb of the dimensions of the receptacle 82. In this rectangular cavity is mounted an intercept device 104 of the same dimensions as the rectangular cavity except that it is not as deep, leaving a space between the back surface of the intercept device 104 and the back surface of the receptacle 82. The front of the intercept device 104 has a cavity 88 bored with a shoulder 90 and a passage 92 therethrough to receive the shaft 94 of a large screw-headed fastener 96. The end of the shaft 94 is pierced by a pin 98. In the back of the receptacle 82 is an aperture 110 of the same cross-sectional shape as the shaft 94 and the pin 98. A pair of guide posts 112 are affixed to the back of the receptacle 82 in any convenient manner. Each passes through a spring 114 restrained between the back surface of the intercept device 104 and the receptacle 82, and slidably through a respective cavity 116 formed in the intercept device 104. The springs 114 are of such a size that they can be compressed to permit the intercept device 104 to be retracted completely into the receptacle 82.

When the intercept device 104 is pressed into the receptacle 82, the shaft 94 with the pin 98 is inserted through the aperture 110 into the space 84. A quarter-turn of the screw-head 96 with a screwdriver engages the pin 98 with the back of the receptacle 82, locking the intercept device 104 in its retracted, inoperative position, with its face 118 flush with the face of the jamb 30. Conversely, disengagement of the pin 98 permits the pressure of the springs 114 to extend the intercept device 104 into its operative position shown in FIG. 7. In this position pins 120 at the top and bottom of the intercept device 104, which ride in the elongate rectangular slots 86 in the top and bottom of the receptacle 82, restrain the device 104 against hyperextension.

FIGS. 8 and 9 show another embodiment of the doorstop of the invention. The intercept device 106 is for mounting on the inside of a door 22 temporarily fixed in place, or on a doorjamb such as 30. A guide 120 is affixed to the door 22 by any conventional means, and the intercept device 106 is retractably extendable therefrom to selectively perform the intercept function. A guide slot 122 restricts the travel of the intercept device by engagement with a pin 124 which moves within the guide slot. The intercept device 106 can be held in either the extended operable position shown in FIG. 8, or the retracted inoperable position (not shown) by a spring-loaded detent ball 126 which fits into either of a pair of detent apertures 120 as depicted in the drawing.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A selectively operable doorstop for converting a double-acting door having a closed position and two open positions to a single-acting door having a closed position and one open position, said door having top and bottom ends, a hinged edge and a swinging edge and having a fixed support opposite and immediately adjacent to said swinging edge in said closed position, said doorstop comprising:

(a) intercept means, having operative and inoperative modes respectively, for selectively either intercepting and preventing said swinging edge from moving beyond said closed position to one of said open positions while permitting free swinging movement of said swinging edge to the other of said open positions when in said operative mode or, alternatively, selectively permitting free swinging movement of said swinging edge to either of said two open positions when in said inoperative mode;

(b) intercept mounting means for fixedly fastening to said fixed support between said top and bottom ends of said door; and (c) mating engagement means, on said intercept means and said mounting means respectively, for mounting said intercept means movably on said mounting means so as to permit selective movement of said intercept means relative to said mounting means between said operative and inoperative modes respectively, said engagement means including means for selectively removably mounting said intercept means on said mounting means and means for permitting said intercept means to slide vertically with respect to said mounting means.

2. A selectively operable doorstop for converting a double-acting door having a closed position and two open positions to a single-acting door having a closed position and one open position, said door having top and bottom ends, a hinged edge and a swinging edge and having a fixed support opposite and immediately adjacent to said swinging edge in said closed position, said doorstop comprising:

(a) intercept means, having operative and inoperative modes respectively, for selectively either intercepting and preventing said swinging edge from moving beyond said closed position to one of said open positions while permitting free swinging movement of said swinging edge to the other of said open positions when in said operative mode or, alternatively, selectively permitting free swinging movement of said swinging edge to either of said two open positions when in said inoperative mode, said intercept means comprising a generally U-shaped member having a center portion and leg portions extending substantially at right angles thereto for removably receiving said fixed support, one of said leg shaped portions of said U-shaped member extending in opposite directions beyond said center portion thereof so as to intercept said swinging edge of said door;

(b) intercept mounting means for fixedly fastening to said fixed support between said top and bottom ends of said door; and (c) mating engagement means, on said intercept means and said mounting means respectively, for mounting said intercept means movably on said mounting means so as to permit selective movement of said intercept means relative to said mounting means between said operative and inoperative modes, respectively.

3. The doorstop described in claim 2, wherein said center portion of said U-shaped member has aperture means formed therein for permitting passage of a latch-bolt therethrough.

4. A door and selectively operable doorstop assembly for converting a double-acting door having a closed position and two open positions to a single-acting door having a closed position and one open position, said door having top and bottom ends, a hinged edge and a swinging edge and said assembly including a fixed support opposite and immediately adjacent to said swinging edge in said closed position, said assembly further comprising:

(a) intercept means, having operative and inoperative modes respectively, for selectively either intercepting and preventing said swinging edge from moving beyond said closed position to one of said open positions while permitting free swinging movement of said swinging edge to the other of said open positions when in said operative mode or, alternatively, selectively permitting free swinging movement of said swinging edge to either of said two open positions when in said inoperative mode;

(b) intercept mounting means fixedly fastened to said fixed support between said top and bottom ends of said door;

(c) mating engagement means, on said intercept means and said mounting means respectively, mounting said intercept means movably on said mounting means for permitting selective movement of said intercept means relative to said mounting means between said operative and inoperative modes, respectively; and (d) a door frame, said fixed support comprising a fixed swinging edge of a second opposed double-acting door which is fixed to said frame in a closed position.

5. The assembly described in claim 4 including locking means movably mounted on said fixed swinging edge for detachably fixing said swinging edge to said frame.

6. A door and selectively operable doorstop assembly for converting a double-acting door having a closed position and two open positions to a single-acting door having a closed position and one open position, said door having top and bottom ends, a hinged edge and a swinging edge and said assembly including a fixed support opposite and immediately adjacent to said swinging edge in said closed position, said assembly further comprising:

(a) intercept means, having operative and inoperative modes respectively, for selectively either intercepting and preventing said swinging edge from moving beyond said closed position to one of said open positions while permitting free swinging movement of said swinging edge to the other of said open positions when in said operative mode or, alternatively, selectively permitting free swinging movement of said swinging edge to either of said two open positions when in said inoperative mode, said intercept means comprising a generally U-shaped member having a center portion and leg portions extending along opposite sides of said fixed support;

(b) intercept mounting means fixedly fastened to said fixed support between said top and bottom ends of said door; and (c) mating engagement means, on said intercept means and said mounting means respectively, mounting said intercept means movably on said mounting means for permitting selective movement of said intercept means relative to said mounting means between said operative and inoperative modes, respectively.

7. The assembly described in claim 6 wherein said locking means comprises elongate means mounted longitudinally vertically within said fixed swinging edge and movable vertically with respect thereto between a first position fixing said swinging edge to said frame and a second position releasing said swinging edge from said frame, further including retainer means selectively removably mounted within said swinging edge for selectively retaining said locking means in said first position when mounted on said swinging edge and permitting said locking means to move to said second position when removed from said swinging edge.

8. A door and selectively operable doorstop assembly for converting a double-acting door having a closed position and two open positions to a single-acting door having a closed position and one open position, said door having top and bottom ends, a hinged edge and a swinging edge and said assembly including a fixed support opposite and immediately adjacent to said swinging edge in said closed position, said assembly further comprising:

(a) intercept means, having operative and inoperative modes, respectively, for selectively either intercepting and preventing said swinging edge from moving beyond said closed position to one of said open positions while permitting free swinging movement of said swinging edge to the other of said open positions when in said operative mode or, alternatively, selectively permitting free swinging movement of said swinging edge to either of said two open positions when in said inoperative mode;

(b) intercept mounting means fixedly fastened to said fixed support between said top and bottom ends of said door; and (c) mating engagement means, on said intercept means and said mounting means respectively, mounting said intercept means movably on said mounting means for permitting selective movement of said intercept means relative to said mounting means between said operative and inoperative modes, respectively, said intercept mounting means having a face in a location opposite to and facing said swinging edge in said closed position, said engagement means on said intercept means including means for detachably fastening said engagement means on said face, said face having slotted aperture means formed therein and said engagement means having boss means for matingly and slidably inserting into said aperture means.

9. A selectively operable doorstop for converting a double-acting door of the type having a closed position and two open positions on opposite sides of the closed position, top and bottom ends, a hinged edge and a swinging edge, and a fixed support opposite and immediately adjacent to said swinging edge in said closed position; to a single-acting door having a closed position and one open position, said doorstop comprising:

(a) receptacle means, adapted to be disposed within said fixed support and defining a substantially rectangular cavity therein, for receiving an intercept means;

(b) substantially rectangular intercept means, having operative and inoperative modes respectively, for selectively either intercepting and preventing said swinging edge from moving beyond said closed position to one of said two open positions on opposite sides of said closed position while permitting free swinging movement of said swinging edge to the other of said open positions when in said operative mode or, alternatively, selectively permitting free swinging movement of said swinging edge to either of said two open positions when in said inoperative mode, said intercept means being disposed at least partially outside said cavity in said operative mode and substantially fully within said cavity in said inoperative mode;

(c) spring means, associated with said receptacle means and said intercept means, for urging said intercept means out of said cavity from said inoperative mode to said operative mode; and (d) fastener means for releaseably holding said intercept means in said inoperative mode within said cavity, said fastener means having an elongate shaft disposed within a passage through said intercept means, a screw head attached to a first end of said shaft and disposed within a cavity in an outwardly-facing portion of said intercept means, and rotational locking means attached to a second end of said shaft for releasably engaging said receptacle means when said intercept means is in its inoperative mode, said locking means being operated by rotation of said screw head.

10. The doorstop of claim 9, further comprising means associated with said receptacle means and said intercept means for guiding said intercept means into and out of said cavity.

* * * * *